US009638499B2

(12) United States Patent
Perry

(10) Patent No.: US 9,638,499 B2
(45) Date of Patent: May 2, 2017

(54) INSERT/OUTSERT ASSEMBLY FOR AN ARROW

(71) Applicant: Barnett Outdoors, LLC, Tarpon Springs, FL (US)

(72) Inventor: Dale Perry, Goodyear, AZ (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 14/829,047

(22) Filed: Aug. 18, 2015

(65) Prior Publication Data

US 2016/0054106 A1 Feb. 25, 2016

Related U.S. Application Data

(60) Provisional application No. 62/040,049, filed on Aug. 21, 2014.

(51) Int. Cl.
*F42B 6/08* (2006.01)
*F42B 6/04* (2006.01)

(52) U.S. Cl.
CPC . *F42B 6/04* (2013.01); *F42B 6/08* (2013.01)

(58) Field of Classification Search
CPC ..... F42B 6/06; F42B 6/08
See application file for complete search history.

(56) References Cited

U.S. PATENT DOCUMENTS 4,671,517 A * 6/1987 Winters ..... F42B 6/08 403/165
4,874,180 A 10/1989 Fingerson
4,986,550 A * 1/1991 Segovia ..... F42B 6/08 473/584
5,234,220 A * 8/1993 Schellhammer ..... F42B 6/04 156/180
5,611,542 A 3/1997 Saunders
7,004,859 B2 2/2006 Palomaki
8,016,703 B1 * 9/2011 Kronengold ..... F42B 6/08 473/582
8,475,303 B2 * 7/2013 James ..... F42B 6/08 473/578
8,668,605 B1 * 3/2014 Huang ..... F42B 6/08 473/582
2003/0159683 A1 8/2003 Muller
2009/0163308 A1 * 6/2009 Odabachian ..... F42B 6/08 473/582

OTHER PUBLICATIONS

International Search Report and Written Opinion from Applicant's corresponding International Application No. PCT/US2015/045844, filed Aug. 19, 2015, titled "Insert/Ousert Assembly for an Arrow."

* cited by examiner

*Primary Examiner* — John Ricci
(74) *Attorney, Agent, or Firm* — Jones Walker LLP

(57) ABSTRACT

An insert/outsert assembly for an arrow. The insert includes a cylindrical body having first and second ends. The second end of the insert is dimensioned to fit within the bore of an arrow shaft. The first end includes a prong containing male threads. The outsert includes a cylindrical wall with an arrowshaft end and an arrowhead end. A center bore extends between the arrowshaft and arrowhead ends. The center bore contains a threaded region with female threads located intermediate of the arrowhead end and arrowshaft end. The insert is threadedly connected to the outsert. An arrowhead is threadedly connected to the outsert.

22 Claims, 4 Drawing Sheets

INSERT/OUTSERT ASSEMBLY FOR AN ARROW

CROSS-REFERENCE TO RELATED APPLICATIONS

This application claims the benefit of and priority to U.S. Provisional Application No. 62/040,049, filed on Aug. 21, 2014, which application is incorporated herein by reference.

BACKGROUND OF THE INVENTION

The present invention relates to an insert/outsert assembly for arrows.

SUMMARY OF THE INVENTION

Embodiments of the invention include and insert and outsert for an arrow or an insert/outsert assembly. The insert/outsert assembly may include an insert having a cylindrical body with a first end and a second end. The second end may be dimensioned to fit within a bore of an arrow shaft. The first end may terminate in a prong containing male threads. The insert/outsert assembly may also include an outsert having a cylindrical wall with an arrowshaft end and an arrowhead end. The cylindrical wall may also include a center bore extending between the arrowshaft end and the arrowhead end. The center bore may contain a threaded region containing female threads. The threaded region may be located intermediate of the arrowhead end and the arrowshaft end and may extend between a top shoulder and a bottom shoulder. The female threads of the threaded region may be threadedly connectable to the male threads of the prong.

In an embodiment, the insert may include a radially extending flange positioned at the first end below the prong. The radially extending flange may have an upper edge that receives and supports an arrowhead shoulder of an arrowhead. The radially extending flange may also have a bottom edge that contacts a terminal end of an arrow shaft.

In an embodiment, the outer surface of the second end of the insert includes a plurality of pockets. The plurality of pockets may be dimensioned to receive a glue.

In an embodiment, the arrowshaft end of the cylindrical wall of the outsert may be tapered. The arrowshaft end of the cylindrical wall of the outsert may be tapered inwardly.

In an embodiment, the center bore of the outsert may contain an arrowhead adapter chamber positioned above the threaded region. The arrowhead adapter chamber may be dimensioned to accommodate an arrowhead adapter section of an arrowhead. The center bore of the outsert may contain an arrowshaft chamber positioned below the threaded region. The arrowshaft chamber may be dimensioned to accommodate a terminal end of the arrow shaft.

In an embodiment, the insert/outsert assembly also includes an arrowhead. The arrowhead may include an arrowhead adapter section with an extension member containing male threads for threaded connection to the female threads of the threaded region of the outsert. The arrowhead adapter section may include an arrowhead shoulder that contacts a top edge of the arrowhead adapter chamber.

In another embodiment an assembly for an arrow is provided that includes an insert having a cylindrical body with a first end and a second end. The second end may be dimensioned to fit within a bore of an arrow shaft. The first end may terminate in a prong containing male threads. The assembly may include an arrowhead including an upper target penetrating section and a lower insert connecting section. The lower insert connecting section may include a bottom wall section containing an interior bore that terminates at a threaded region section. The threaded region section may include female threads for connecting with the male threads of the prong of the insert.

In an embodiment, the upper target penetrating section may be a broadhead or a practice point.

In an embodiment, the bottom wall section may be tapered. The bottom wall section may be tapered inwardly.

Embodiments of the invention also include a method of assembling an arrow. The method may include the step of providing an insert/outsert assembly comprising: an insert having a cylindrical body with a first end and a second end, the second end dimensioned to fit within a bore of an arrow shaft, the first end terminating in a prong containing male threads; an outsert having a cylindrical wall with an arrowshaft end and an arrowhead end, a center bore extending between the arrowshaft end and the arrowhead end, the center bore containing a threaded region containing female threads, the threaded region located intermediate of the arrowhead end and the arrowshaft end and extending between a top shoulder and a bottom shoulder, the female threads of the threaded region being threadedly connectable to the male threads of the prong. The method may also include the step of inserting the second end of the insert into the bore of the arrowshaft. The method may also include the step of threadedly connecting the outsert to the insert.

In an embodiment, the method may include the step of gluing the second end of the insert to an internal bore wall of the arrowshaft.

In an embodiment, the method may include the step of providing an arrowhead, the arrowhead including an arrowhead adapter section with an extension member containing male threads for threaded connection to the female threads of the threaded region of the outsert. The method also may include the step of threadedly connecting the arrowhead to the outsert.

In an embodiment, the arrowhead may be threadedly connected to the outsert before the outsert is threadedly connected to the insert.

In an embodiment, the method may also include the steps of: disconnecting the arrowhead from the outsert; disconnecting the outsert from the insert; threadedly connecting a second outsert to the insert, the second outsert having a weight different from the disconnected outsert; and threadedly reconnecting the disconnected arrowhead to the second outsert.

DETAILED DESCRIPTION OF THE INVENTION

Figure 1:
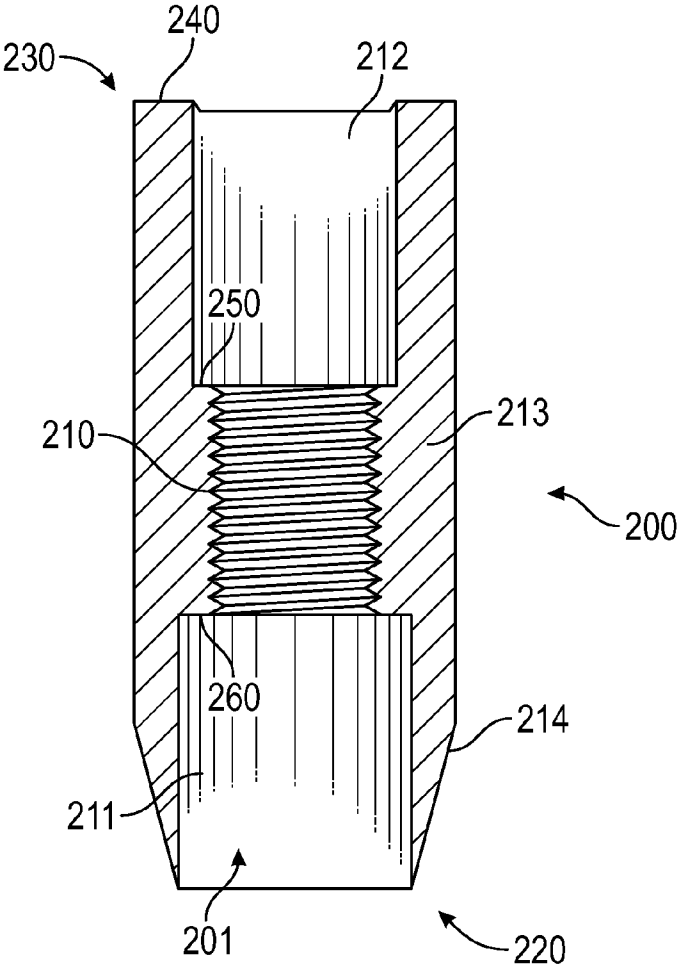
FIG. 1 is a cross-sectional view of an embodiment of an outsert.
Figure 3:
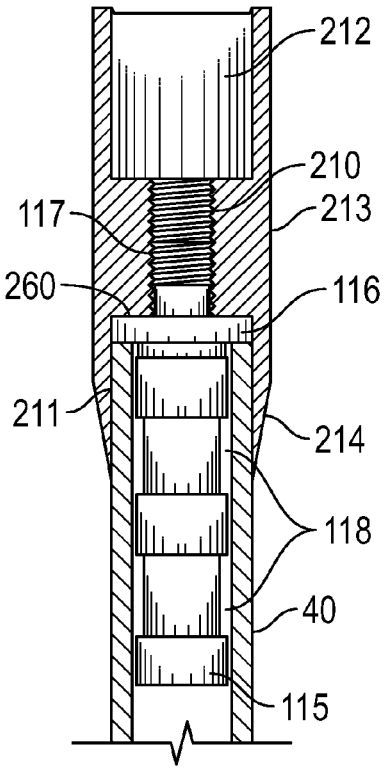
FIG. 3 is a cross-sectional view of an embodiment of an insert/outsert assembly in operative association with an arrow.

With reference to FIGS. 1 and 3, outsert 200 may contain cylindrical wall 213 with center bore 201. Outsert 200 may also include arrow shaft end 220 and arrowhead end 230. At arrow shaft end 220, cylindrical wall 213 may contain tapered section 214. Tapered section 214 may taper inwardly so that the thickness of cylindrical wall 213 gradually thins at arrowhead shaft end 230 to provide a smooth transition between outsert 200 and arrow shaft 40 when outsert 200 is operatively positioned about arrow shaft 40 as seen in FIG. 3. The transition between a constant diameter of cylindrical wall 213 and tapered section 214 may begin at a position that is approximately half the length of arrow shaft chamber 211. Arrow shaft chamber 211 may be formed in the section of center bore 201 that is positioned adjacent the arrow shaft end 220. Arrow shaft chamber 211 may have an inner diameter substantially equal to or slightly greater than that of the outer diameter of arrow shaft 40 to receive arrow shaft 40 in arrow shaft chamber 211. The inner diameter of arrow shaft chamber 211 may vary based on the outer diameter of the mating arrow shaft 40. With the outsert shaft end 220 surrounding the terminating end of arrow shaft 40, outsert 200 (in operative connection with insert 100) provides structural support and additional strength to the terminal end of arrow shaft 40, a traditionally weak point in an arrow. The length of tapered section 214 may vary. In one embodiment, tapered section 214 may have a length of about 0.2 to 1.5 inches or 0.5 to 0.75 inches.

Again with reference to FIGS. 1 and 4, center bore 201 of outsert 200 may include interior top shoulder 250 and interior bottom shoulder 260. In the region of cylindrical wall 213 between interior top and bottom shoulders 250, 260, cylindrical wall 213 is thicker and accommodates interior female threaded region 210. Female threaded region 210 is designed to threadedly engage with cooperating male threads of prong 117 of insert 100 and with cooperating male threads of extension member 511 of arrowhead adaptor section 510 of arrowhead 300. In one exemplary embodiment, interior female threaded region 210 may be from about 0.1 inches to 1.5 inches, or from about 0.03 inches to 1.0 inches, or about 0.5 inches in length. Top interior shoulder 250 may be chamfered to accommodate any curvature in arrowhead shoulder 512.

Figure 4:
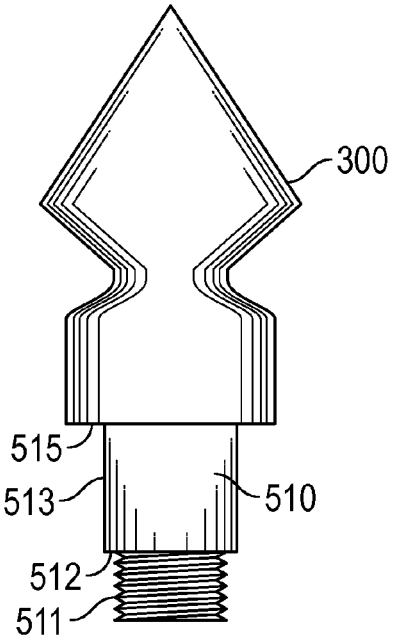
FIG. 4 is a cross-sectional view of an arrowhead.

As seen in FIGS. 1 and 4, arrowhead adapter chamber 212 may be formed in the section of center bore 201 above interior top shoulder 250. Arrowhead adapter chamber 212 may be sized to accommodate smooth cylindrical end 513 of the arrowhead adaptor 510. Top edge 240 of arrowhead adaptor chamber 212 may be chamfered to accommodate any curvature in arrowhead adaptor 510 at or near arrowhead shoulder 515. In exemplary embodiments, the inner diameter of arrowhead chamber 212 may range from 0.20 to 0.25 inches or from 0.231 to 0.243 inches, or about 0.205 inches.

The length of outsert 200 can vary. Exemplary lengths may be about 1.0 to 2.0 inches or 1.41 inches to 1.62 inches.

Extension member 511 of arrowhead adapter section 510 of arrowhead 300 may secured to outsert 200 by threaded connection between the male threads on extension member 511 of arrowhead 300 and the threads on interior female threaded region 210 of outsert 200. Shoulder 512 of arrowhead adapter 510 will contact and seat on interior top shoulder 250 of outsert 200.

The material composition of outsert 200, its overall length and wall thickness, can vary to provide for multiple outserts 200 having different weights. Outserts of differing weights provides the feature of a variable weighted arrow. For example, an archer has the option of changing the weight at the front of arrow 40 to better suit the archery application and to help fine tune arrow 40 for optimum flight characteristics by selecting an outsert 200 of a desired weight. The weight of outsert 200 may range from about 30 to 100 grains or from about 0.068 to 0.228 ounces.

Figure 2:
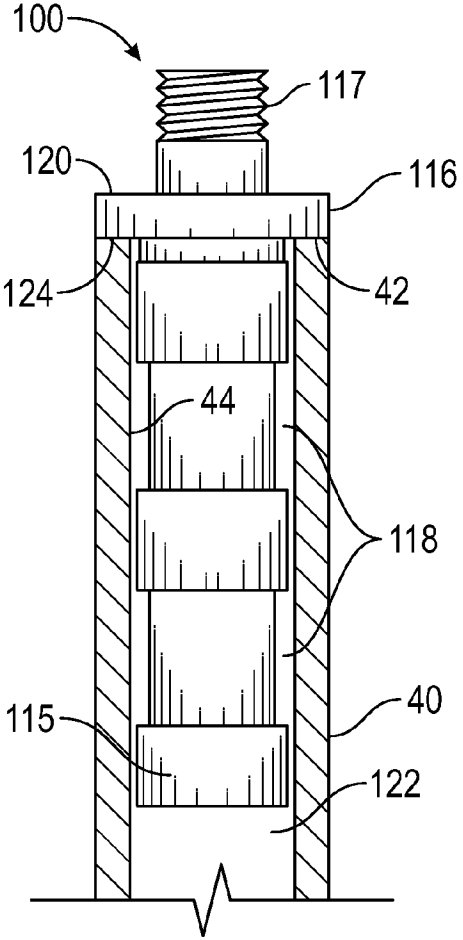
FIG. 2 is a cross-sectional view of an embodiment of an insert in operative association with an arrow.

FIG. 2 depicts an embodiment of insert 100 inserted into a chamber or centerbore 122 in arrow shaft 40. Insert 100 may include cylindrical lower body 115 that terminates in a flange, collar or stop 116, above which is upwardly extending male prong 117 containing threads. Prong 117 is positioned on the center axis of insert 100. Prong 117 is sized to threadedly engage with interior female threaded region 210 of the outsert 200. Cylindrical lower body 115 of insert 100 may have one or more grooves, slots, or pockets 118, such as the circumferential pockets 118 shown in FIG. 2, or other surface variations to accommodate glue or adhesive. When threadedly connected with outsert 200, the upper edge 120 of insert stop 116 may seat against interior bottom shoulder 260 of outsert 200. The length of insert 100 may vary. In an exemplary embodiment, the length of insert 100 may be from about 1.0 to 2.0 inches or about 1.5 inches. The outer diameter of insert 100 at lower body end 115 may be from about 1.0 to 2.0 inches or about 1.65 inches.

Both insert 100 and outsert 200 may be made of high carbon steel, stainless steel, or other metal alloy, such as aluminum or magnesium.

FIG. 3 shows insert 100 an outsert 200 (or the insert/outsert assembly) installed to arrow shaft 40. To assemble the insert/outsert assembly within arrow shaft 40, insert 100 is fixed in center bore 122 of the arrow shaft 40. Bottom edge 124 of insert stop 116 contacts terminal end 42 of the arrow shaft 40. Insert 100 may be fixed within center bore 122 by contact of the outer surface of lower cylindrical body 115 with the inner surface of bore wall 44 of arrow shaft 40. Alternatively, the outer surface of lower cylindrical body 115 of insert 100 may be glued to bore wall 44. The glue may be placed within pockets 118. Outsert 200 is then threadedly connected to insert 100 by mating the female threads of interior female threaded region 210 to the male threads of prong 117 until top edge 120 of insert stop 116 contacts shoulder 260. Arrowhead 300 may now be threadedly connected to outsert 200 by mating the male threads of extension member 511 to the female threads of interior female threaded region 210. Alternatively, arrowhead 300 could be first threaded connected to outsert 200 and then the assembly of the arrowhead 40 and outsert 200 threaded connected to insert 100 as described above.

The insert/outsert assembly allows for ease of assembly, strengthens the tip of arrow shaft 40, and provides the ability to change tip weights and tip configurations without removing the glued insert from arrow shaft 40, thus avoiding damaging the arrow shaft.

Additionally, the system also allows an archer to disassemble outsert 200 from insert 100 so that insert 100 may be used as a means to directly connect with an arrowhead that is modified to threadedly connect with prong 117 of insert 100. For example, arrowhead 300 may be modified to remove arrowhead adapter section 510, which is replaced with a female adapter capable of threadedly connecting to prong 117 of insert 100.

Figure 5:
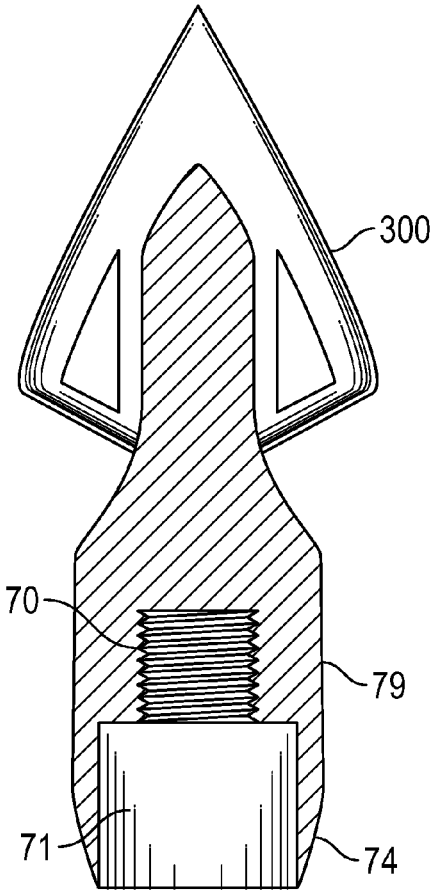
FIG. 5 is a cross-sectional view of an embodiment of an arrowhead in the form of a broadhead that may be used with the insert shown in FIG. 2.

With reference to FIG. 5, broadhead 300 is configured with bottom wall section 79 that contains interior bore 71 that terminates in female threaded region section 70. Bottom wall section 79 may contain tapered section 74 similar in design and function as described above in connection with tapered section 214 of outsert 200. Female threaded region section 70 is threadedly connected to the male threads of prong 117 to directly connect arrowhead 300 to insert 100.

Figure 6:
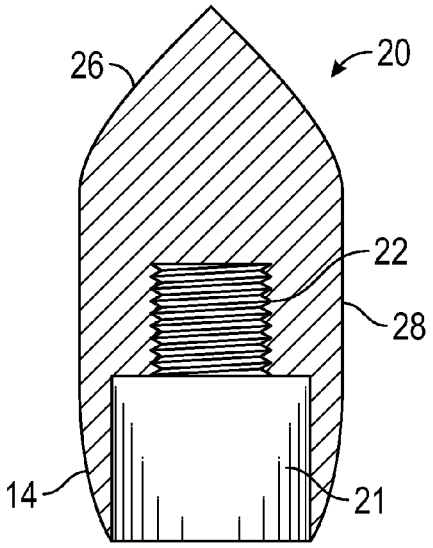
FIG. 6 is a cross-sectional view of an embodiment of an arrowhead in the form of a practice point that may be used with the insert shown in FIG. 2.

With reference to FIG. 6, practice point 20 is configured with bottom wall section 28 that contains interior bore 21 that terminates in female threaded region section 22. Bottom wall section 28 may contain tapered section 14 similar in design and function as described above in connection with tapered section 214 of outsert 200. Female threaded region section 22 is threadedly connected to the male threads of prong 117 to directly connect practice point 20 to insert 100.

Figure 7:
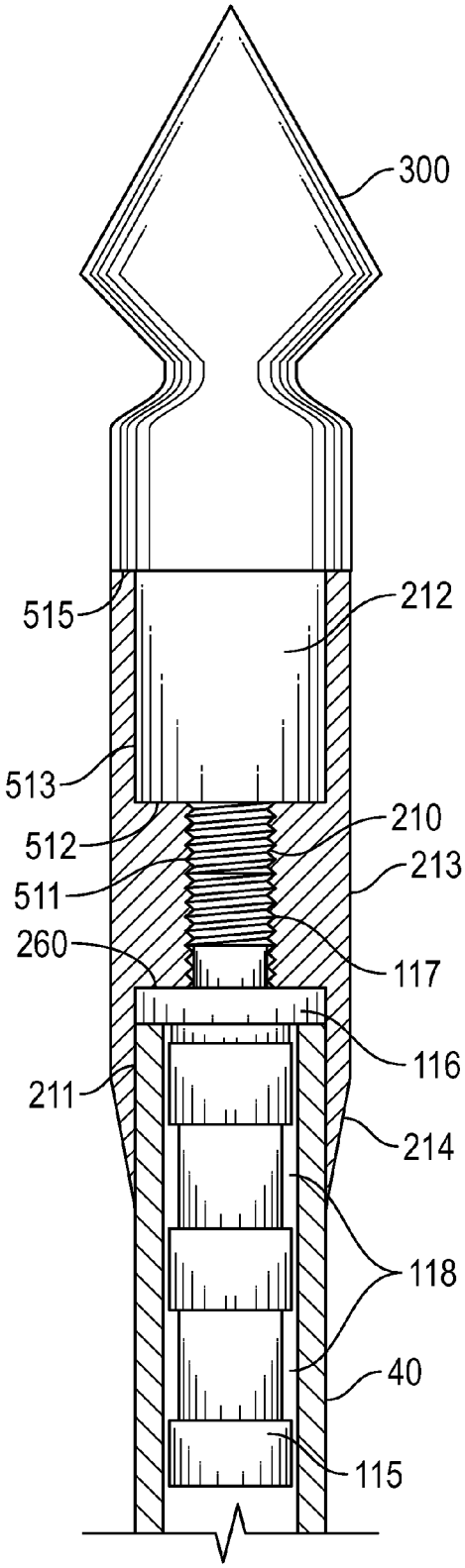
FIG. 7 is a cross-sectional view of an embodiment of an arrowhead operatively associated with an embodiment of an insert/outsert assembly in operative position on an arrow.

FIG. 7 shows insert/outsert assembly operatively positioned within arrow shaft 40 with arrowhead 300 operatively connected to the insert/outsert assembly as described above.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains

What is claimed is:

1. An insert/outsert assembly for an arrow, comprising:

an insert having a cylindrical body with a first end and a second end, the second end dimensioned to fit within a bore of an arrow shaft, the first end terminating in a prong containing male threads;

an outsert having a cylindrical wall with an arrowshaft end and an arrowhead end, a center bore extending between the arrowshaft end and the arrowhead end, the center bore containing a threaded region containing female threads, the threaded region located intermediate of the arrowhead end and the arrowshaft end and extending between a top shoulder and a bottom shoulder, the female threads of the threaded region being threadedly connectable to the male threads of the prong.

2. The assembly of claim 1 wherein the insert includes a radially extending flange positioned at the first end below the prong.

3. The assembly of claim 2 wherein the radially extending flange has an upper edge that receives and supports an arrowhead shoulder of an arrowhead.

4. The assembly of claim 3 wherein the radially extending flange has a bottom edge that contacts a terminal end of an arrow shaft.

5. The assembly of claim 1 wherein an outer surface of the second end of the insert includes a, plurality of pockets.

6. The assembly of claim 5 wherein the plurality of pockets are dimensioned to receive a glue.

7. The assembly of claim 1 wherein the arrowshaft end of the cylindrical wall of the outsert is tapered.

8. The assembly of claim 7 wherein the arrowshaft end of the cylindrical wall of the outsert is tapered inwardly.

9. The assembly of claim 1 wherein the center bore of the outsert contains an arrowhead adapter chamber positioned above the threaded region.

10. The assembly of claim 9 wherein the arrowhead adapter chamber is dimensioned to accommodate an arrowhead adapter section of an arrowhead.

11. The assembly of claim 1 wherein the center bore of the outsert contains an arrowshaft chamber positioned below the threaded region.

12. The assembly of claim 11 wherein the arrowshaft chamber is dimensioned to accommodate a terminal end of the arrow shaft.

13. The assembly of claim 1 further comprising an arrowhead, the arrowhead including an arrowhead adapter section with an extension member containing male threads for threaded connection to the female threads of the threaded region of the outsert.

14. The assembly of claim 13 wherein the arrowhead adapter section includes an arrowhead shoulder that contacts a top edge of the arrowhead adapter chamber.

15. An assembly for an arrow, comprising:

an insert having a cylindrical body with a first end and a second end, the second end dimensioned to fit within a bore of an arrow shaft, the first end terminating in a prong containing male threads;

an arrowhead including an upper target penetrating section and a lower insert connecting section, the lower insert connecting section including a bottom wall section containing an outer surface tapered inwardly towards an arrow shaft end of the arrowhead and an interior bore having a uniform inner diameter that terminates at a threaded region section and dimensioned for accommodation of the arrow shaft, the threaded region section including female threads for connecting with the male threads of the prong of the insert.

16. The assembly of claim 15 wherein the upper target penetrating section is a broadhead.

17. The assembly of claim 15 wherein the upper target penetrating section is a practice point.

18. A method of assembling an arrow comprising the steps of:

a) providing an insert/outsert assembly comprising: an insert having a cylindrical body with a first end and a second end, the second end dimensioned to fit within a bore of an arrow shaft, the first end terminating in a prong containing male threads; an outsert having a cylindrical wall with an arrowshaft end and an arrowhead end, a center bore extending between the arrowshaft end and the arrowhead end, the center bore containing a threaded region containing female threads, the threaded region located intermediate of the arrowhead end and the arrowshaft end and extending between a top shoulder and a bottom shoulder, the female threads of the threaded region being threadedly connectable to the male threads of the prong;

b) inserting the second end of the insert into the bore of the arrowshaft; and c) threadedly connecting the outsert to the insert.

19. The method of claim 18 wherein step (b) also includes the step of gluing the second end of the insert to an internal bore wall of the arrowshaft.

20. The method of claim 18 further comprising the steps of:

d) providing an arrowhead, the arrowhead including an arrowhead adapter section with an extension member containing male threads for threaded connection to the female threads of the threaded region of the outsert;

C) threadedly connecting the arrowhead to the outsert.

21. The method of claim 20 wherein the arrowhead is threadedly connected to the outsert before the outsert is threadedly connected to the insert.

22. The method of claim 20 further comprising the steps of:

f) disconnecting the arrowhead from the outsert;

g) disconnecting the outsert from the insert;

h) threadedly connecting a second outsert to the insert, the second outsert having a weight different from the disconnected outsert; and i) threadedly reconnecting the disconnected arrowhead to the second outsert.

* * * * *